US008855904B1

(12) United States Patent
Templeton et al.

(10) Patent No.: US 8,855,904 B1
(45) Date of Patent: Oct. 7, 2014

(54) USE OF POSITION LOGS OF VEHICLES TO DETERMINE PRESENCE AND BEHAVIORS OF TRAFFIC CONTROLS

(71) Applicant: Google Inc., Mountain View, CA (US)

(72) Inventors: Bradley Templeton, Sunnyvale, CA (US); Eli Brandt, Seattle, WA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/648,282

(22) Filed: Oct. 10, 2012

(51) Int. Cl.
*G08G 1/00* (2006.01)

(52) U.S. Cl.
USPC ..... 701/119; 701/117; 340/988

(58) Field of Classification Search
None
See application file for complete search history.

(56) References Cited

U.S. PATENT DOCUMENTS

| | | | | |
|---|---|---|---|---|
| 5,371,678 | A * | 12/1994 | Nomura | 701/414 |
| 5,559,673 | A | 9/1996 | Gagnon | |
| 6,236,933 | B1 * | 5/2001 | Lang | 701/117 |
| 7,317,406 | B2 * | 1/2008 | Wolterman | 340/917 |
| 7,398,076 | B2 * | 7/2008 | Kubota et al. | 455/344 |
| 8,471,728 | B2 * | 6/2013 | Flaherty | 340/905 |
| 8,483,940 | B2 * | 7/2013 | Chapman et al. | 701/117 |
| 8,548,729 | B2 * | 10/2013 | Mizuguchi | 701/301 |
| 8,559,673 | B2 * | 10/2013 | Fairfield et al. | 382/104 |
| 8,666,716 | B2 * | 3/2014 | Yonekawa et al. | 703/8 |
| 2005/0046597 | A1 * | 3/2005 | Hutchison et al. | 340/917 |
| 2008/0255754 | A1 * | 10/2008 | Pinto | 701/119 |
| 2009/0005984 | A1 * | 1/2009 | Bradley | 701/213 |
| 2011/0029224 | A1 * | 2/2011 | Chapman et al. | 701/118 |
| 2011/0037619 | A1 * | 2/2011 | Ginsberg et al. | 340/910 |
| 2011/0205086 | A1 * | 8/2011 | Lamprecht et al. | 340/928 |
| 2012/0109510 | A1 * | 5/2012 | Ota et al. | 701/400 |
| 2012/0277985 | A1 * | 11/2012 | Witmer | 701/119 |

OTHER PUBLICATIONS

Koukoumidis, Emmanouil et al., "SignalGuru: Leveraging Mobile Phones for Collaborative Traffic Signal Schedule Advisory" MobiSys '11, Bethesda, MD, available at http://www.dcg.ethz.ch/lectures/fs12/seminar/paper/Jochen/2.pdf, Jun. 28-Jul. 1, 2011.

* cited by examiner

*Primary Examiner* — John R Olszewski
*Assistant Examiner* — James M McPherson
(74) *Attorney, Agent, or Firm* — McDonnell Boehnen Hulbert & Berghoff LLP

(57) ABSTRACT

Methods and devices for using position logs of vehicles to determine the presence and behavior of traffic controls are disclosed. An example method includes receiving movement data that is indicative of movement of a plurality of vehicles through an intersection. The movement data may be received by a computing device and may include, for each respective vehicle, data indicative of the respective vehicle's position as a function of time for multiple instances of time. The method may further include detecting a pattern in the movement data using the computing device. The detected pattern may be indicative of a probable traffic control for the intersection. According to the method, an indication of the probable traffic control for the intersection may be stored in a database.

17 Claims, 10 Drawing Sheets

200

| Position (lat/lon) | Speed (m/s) | Bearing (degrees) | Time (UNIX) |
|---|---|---|---|
| 41.931444; -87.653775 | 11.176 | 354.0254 | 1346198082 |
| 41.932053; -87.653861 | 11.164 | 354.0215 | 1346198083 |
| 41.932425; -87.653845 | 11.085 | 354.0250 | 1346198084 |
| 41.932944; -87.653866 | 11.124 | 354.0256 | 1346198085 |
| 41.933479; -87.653888 | 11.201 | 354.0211 | 1346198086 |
| 41.933950; -87.653899 | 11.180 | 354.0267 | 1346198087 |

FIGURE 2

USE OF POSITION LOGS OF VEHICLES TO DETERMINE PRESENCE AND BEHAVIORS OF TRAFFIC CONTROLS

BACKGROUND

Some vehicles are configured to operate in an autonomous mode in which the vehicle navigates through an environment with little or no input from a driver. Such a vehicle may include one or more sensors that are configured to sense information about the environment. The vehicle may use the sensed information to navigate through the environment.

For example, if an output of the sensors is indicative that the vehicle is approaching an obstacle, the vehicle may navigate around the obstacle. Additionally, a vehicle may sense information about traffic signs and traffic signals. Traffic signs may provide regulatory information or warning information while traffic signals positioned at road intersections, pedestrian crossings, and other locations may be used to control competing flows of traffic. In an instance in which a map of known locations of traffic controls is available, a vehicle may be prompted to locate a traffic control and respond accordingly. Other types of vehicles may also rely on information about the presence and behavior of traffic controls in an area. For example, mapping applications may utilize a map of known locations of traffic controls to determine driving directions for a vehicle. As another example, driver assistance systems may alert drivers about the presence of a traffic control when their vehicle is approaching a location of the traffic control. Other examples are also possible.

SUMMARY

In one example aspect, a method is disclosed that includes receiving movement data that is indicative of movement of a plurality of vehicles through an intersection. The movement data may be received by a computing device and may include, for each respective vehicle, data indicative of the respective vehicle's position as a function of time for multiple instances of time. The method may further include detecting a pattern in the movement data using the computing device. The detected pattern may be indicative of a probable traffic control for the intersection. According to the method, an indication of the probable traffic control for the intersection may be stored in a database.

In another example aspect, a non-transitory computer-readable medium is disclosed having stored therein instructions executable by a computing device to cause the computing device to perform functions. The functions may include receiving movement data that is indicative of movement of a plurality of vehicles through an intersection. The movement data may include, for each respective vehicle, data indicative of the respective vehicle's position as a function of time for multiple instances of time. The functions may further include detecting a pattern in the movement data. The detected pattern may be indicative of a probable traffic control for the intersection. According to the functions, an indication of the probable traffic control for the intersection may be stored in a database.

In yet another example aspect, a system comprising at least one processor and a memory is disclosed. The system may also include instructions stored in the memory and executable by the at least one processor to cause the at least one processor to perform functions. The functions may include receiving movement data that is indicative of movement of a plurality of vehicles through an intersection. The movement data may include, for each respective vehicle, data indicative of the respective vehicle's position as a function of time for multiple instances of time. The functions may further include detecting a pattern in the movement data. The detected pattern may be indicative of a probable traffic control for the intersection. According to the functions, an indication of the probable traffic control for the intersection may be stored in a database.

The foregoing summary is illustrative only and is not intended to be in any way limiting. In addition to the illustrative aspects, embodiments, and features described above, further aspects, embodiments, and features will become apparent by reference to the figures and the following detailed description.

BRIEF DESCRIPTION OF THE FIGURES

FIG. 2 is an example of movement data for a vehicle.

DETAILED DESCRIPTION

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure as generally describe herein, and illustrated in the figures, can be arranged, substituted, combined, separated, and designed in a wide variety of different configurations, all of which are explicitly contemplated herein.

A vehicle, such as a vehicle configured to operate autonomously, may make use of a map of the positions of traffic controls such as traffic signals, stops signs, and other signs as well as models of the behavior of the traffic signals in order to operate. Additionally, a map of the positions and behaviors of traffic controls may be employed by mapping applications that are configured to determine directions form a point of origin to a destination. According to the systems and methods described herein, movement data, such as position track logs of vehicles, may be used to detect the presence of a probable traffic control at a position. In some instances, a behavior of the traffic control such as a timing pattern may also be determined based on the movement data. The systems and methods may be applicable to detecting the presence and/or behavior of new traffic controls as well as detecting the removal or temporary relocation of a traffic control. Similarly, the systems and methods may also enable detection of changes in the behavior of traffic controls.

An example method may include receiving movement data that is indicative of movement of a plurality of vehicles through an intersection and detecting a pattern in the movement data. For instance, the movement data may be received by a computing device and include data indicative of the vehicles' positions as a function of time. In one case, position track logs may be received from mobile devices of users within vehicles in near-real time. For example, the position track logs may include a series of GPS readings that record position, velocity vector, and time. The computing device may be configured to process the logs and correlate the positions with a known map of streets and lanes. Additionally, the computing device may detect patterns, such as patterns in velocity near intersections, to infer the presence and/or behavior of a probable traffic control. In response to detecting one or more patterns, the computing device may store an indication of the probable traffic control in a database or provide the indication to a computing system. Various examples are contemplated and described hereinafter.

Figure 1:
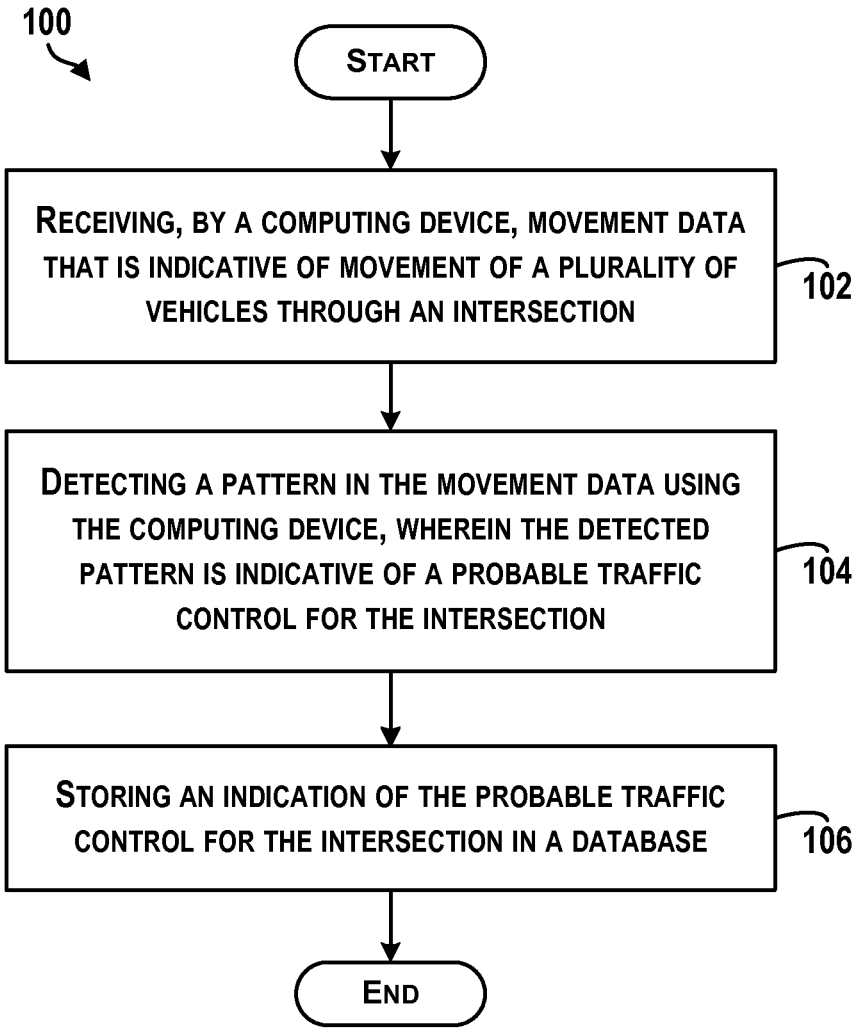
FIG. 1 is a block diagram of an example method of detecting a probable traffic control.

FIG. 1 is a block diagram of an example method 100 of detecting a probable traffic control. Method 100 shown in FIG. 1 presents an embodiment of a method that may be performed by a computing device or a server, such as the computing device 700 of FIG. 7 or components of the computing device 700. Method 100 may include one or more operations, functions, or actions as illustrated by one or more of blocks 102-106. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

In addition, for the method 100 and other processes and methods disclosed herein, the block diagram shows functionality and operation of one possible implementation of present embodiments. In this regard, each block may represent a module, a segment, or a portion of program code, which includes one or more instructions executable by a processor for implementing specific logical functions or steps in the process. The program code may be stored on any type of computer-readable medium, such as, for example, a storage device including a disk or hard drive. The computer-readable medium may include a non-transitory computer-readable medium, for example, such as computer-readable media that store data for short periods of time like register memory, processor cache, and Random Access Memory (RAM). The computer-readable medium may also include non-transitory media, such as secondary or persistent long term storage, like read only memory (ROM), optical or magnetic disks, and compact-disc read only memory (CD-ROM), for example. The computer-readable media may also be any other volatile or non-volatile storage systems. The computer-readable medium may be considered a computer-readable storage medium, a tangible storage device, or other article of manufacture, for example.

In addition, for the method 100 and other processes and methods disclosed herein, each block may represent circuitry that is configured to perform the specific logical functions in the process.

As shown, initially, at block 102, the method 100 includes receiving, by a computing device, movement data that is indicative of movement of a plurality of vehicles through an intersection. In one example, for each respective vehicle, the movement data may include data indicative of the respective vehicle's position as a function of time for multiple instances of time. In further examples, the movement data may include data indicative of velocity or acceleration for one or more of the vehicles as a function of time. The velocity may be a velocity vector including a speed and direction, for example.

In one case, the movement data may be in the form of position track logs from vehicles that are provided in near-real time. The position track logs may be received from mobile devices that are used by users of a vehicle to provide mapping or navigation functions. For instance, the mobile device may be a smartphone, tablet computer, or other computing device that is held by a user or optionally integrated into the vehicle and configured to provide driving directions, mapping functions, traffic conditions, GPS information, or other information for the user and/or the vehicle. The mobile device may periodically send movement data to the computing device or another location that is accessible by the computing device. For instance, the mobile device may provide the movement data via a wireless link (e.g., a satellite or cellular communication network). Thus, in some cases, the movement data may be received from a mobile device of a user that is a driver or passenger of a vehicle as the vehicle drives around an area. In another case, the position track logs may be provided after the fact. For instance, a handheld GPS device or a GPS device that is an integrated component of a vehicle may include software that is configured to store GPS readings as the vehicle drives. The stored GPS readings may then be downloaded or uploaded and provided to the computing device at a later time. Therefore, the movement data may be provided by any combination of stationary or mobile devices that are configured to provide the information in near-real time or after the fact.

In one example, the GPS readings may be a series of readings recording position, velocity vector, and time at fixed intervals (e.g., every second). The method 100 may be applicable to both high accuracy and low accuracy position track logs. In some cases, the position information may be accurate to within less than one meter. For example, the position track logs may be processed with known correction data to produce more accurate logs. In other cases, the position information may be raw GPS data that is less accurate (e.g., accurate to within one meter, accurate to within 20 meters, etc.).

At block 104, the method 100 includes detecting a pattern in the movement data using the computing device, wherein the detected pattern is indicative of a probable traffic control for the intersection. The computing device may be configured to process the movement data and correlate the position data with a known map of streets and lanes. The known map of streets and lanes may include inward leading lanes and outward leading lanes for various intersections that the position information from the movement data may be correlated to. In one example, the computing device may assign a probability to each point of the movement data that represents a probability that the vehicle is within a given lane or on a given road. Based on observed intersection activity for one or more vehicles through an intersection, patterns in velocities and/or accelerations of the one or more vehicles while approaching or traveling through the intersection may be detected and associated with known patterns for various probable traffic controls.

In some instances, the computing device may infer which lane (or group of lanes) a vehicle is in based on the fact that the vehicle is driving in a given direction. For instance, if position data is not accurate enough to pinpoint a vehicle to a given lane, the fact the vehicle is traveling north may be used to infer that the vehicle is in a northbound lane. Additionally, in some cases, the computing device may determine which street or path a vehicle has turned on after the movement and position data indicates the vehicle has traveled along the street or path for a period of time.

In some instances, the computing device may observe that a vehicle or majority of the vehicles approaching an intersection via a given inward lane and leaving the intersection via a given outward lane exhibit a certain behavior. For instance, the vehicles may decrease in velocity on approach to the intersection and drop to zero or near-zero velocity for a short or extended period of time prior to entering the intersection. The computing device may determine that the behavior is indicative that there is a probable cause for stopping at the intersection in the direction of travel via the given inward lane and given outward lane. The computing device may also observe when vehicles or a majority of the vehicles do not stop (e.g., velocity remains above a predetermined threshold) while traveling through an intersection via a particular inward lane and particular outward lane. Collected records of intersection activity may be analyzed to detect patterns based on activity for individual directions of travel through an intersection (e.g., via a given inward lane and given outward lane of an intersection) and/or based on a joint consideration of activity for all directions of travel through the intersection together.

As an example, if a pattern in which all vehicles stop for a modest time on an approach, and almost never go through an intersection without stopping is observed, the pattern may be indicative that the probability of a stop sign or flashing red traffic signal at the position is high. Further, by comparing the behavior of vehicles for all directions of travel through the intersection, it may also be possible to detect whether the intersection activity is indicative of a four-way stop. For example, if all vehicles routinely stop for a modest or brief time in all directions, the probability of a four-way stop is high. In another case, if vehicles routinely go through an intersection without stopping (as indicated by their velocity), the probability that there is no stop sign at the position is high.

As another example, if a pattern in which vehicles sometimes stop, often for extended periods of time without starting and stopping again, on approach to the intersection is observed, the pattern may be indicative of a traffic signal in that direction. Additionally, if it is observed that sometimes vehicles travel through the intersection without stopping, this may reinforce the inference that the probable traffic control is a traffic signal.

As still another example, if a pattern for intersection activity indicates that vehicles sometimes stop to go straight or left, but stop much less often to go right is observed, the observed pattern may be indicative that there is a special right turn lane at the position. Similarly, if a pattern in which vehicles sometimes stop for extended periods of time at an intersection, but vehicles turning right stop only briefly, is detected, the detected pattern may indicate that there is a traffic signal at the intersection for which right turns on red are allowed.

In other examples, patterns of driving activity that are indicative of a temporary lane closure or lane shift, which may or may not be near an intersection, may be detected. For example, the computing device may detect that vehicles traveling along a highway may merge from a left lane to a right lane prior to traveling through a portion of the highway where vehicles traveling in the left lane are not detected. This may be contrary to previously observed movement data where vehicles frequently travel in either lane along the portion of the highway have been detected. As a result, a determination that a merge sign exists may be made based on the detected pattern.

In some cases movement data for multiple vehicles traveling through an intersection at the same point in time may be received. Based on the movement data, additional patterns may be detected. For instance, if it is detected that multiple vehicles traveling in the same direction stop around the same time (e.g., within 1-10 seconds), and then all begin moving again with the same time range, it may be determined that a traffic signal exists for the intersection. Likewise, if it is detected that at a first instance in time, vehicle(s) are stopped in a first direction and other cross-traffic vehicles are not stopping in another direction, and at a second instance in time vehicle(s) are not stopping in the first direction but are stopping in the another direction, the detected pattern may be indicative of the presence of a traffic signal at the intersection.

As another example, a detected pattern may indicate the presence of a protected left turn. For instance, movement data for an intersection may indicate that traffic in an opposite direction does not travel through the intersection while vehicles are turning left. In another instance, a detected pattern may indicate the presence of an ordinary left turn. For example, movement data for an intersection may indicate that vehicles turning left at intersection alternate with vehicles traveling through the intersection in the opposite direction. As still another example, a pattern in which vehicles rarely turn right while cross traffic is traveling through an intersection may indicate the presence of a "No turn on red" sign.

When movement data that is indicative of multiple instances of starting and stopping at an intersection is received, the movement data may also be analyzed to estimate a cycle time for a traffic signal. For example, when recordings of vehicles that are traveling in a given direction and are stopping/starting at an intersection at a first instance in time, and recordings of other vehicles that are traveling in the given direction and are stopping/starting at the intersection at a second instance in time are received, a cycle time may be estimated for the traffic signal. For instance, the cycle time may be related to a duration of time between the first instance in time and the second instance in time. If the pattern is observed multiple times, an average duration may be used to estimate the cycle time. Additionally, if the durations are highly variant, a determination may be made that the traffic signal cycle is triggered by sensors such as magnetic strips in the road. The determination might also take into account the time of day, given that cycle times may change during rush hour, for example.

It is also contemplated that the movement data, when combined with known speed limits, may be used to determine the presence of light or heavy traffic. Based on a current amount of traffic, a probability of a detected traffic control may be adjusted. For instance, in heavy traffic (e.g., when velocities are significantly lower than a known speed limit along a given direction), a low probability/confidence may be associated with any detected traffic controls.

At block 106, the method 100 includes storing an indication of the probable traffic control for the intersection in a database. The indication may include a position of the traffic control, and any associated probability/confidence for the probable traffic control. Further the indication may include a time, date, day of the week, etc. Additionally, in instances in which behaviors of traffic controls, such as a cycle time for a traffic signal, are determined, the behavior information may also be stored in the database.

The indications of the probable traffic controls may also be sent to one or more users or computing devices. For example, if cars begin stopping in a pattern that indicates the presence of a traffic control where one is not known to be present, the probability of a new traffic control is high, and an indication of the probable traffic control may be provided to personnel that are responsible for maintaining maps of traffic controls for autonomous (or other) vehicles. Indications of new traffic controls may also be provided directly to autonomous vehicles such that maps of traffic signals utilized by the autonomous vehicles are updated to include the newly detected traffic control. As another example, if a traffic signal switches from regular mode to an all-way stopping pattern (due to a power failure, e.g.), and an all-way stopping pattern is detected based on movement data for the intersection when a normal traffic signal behavior is expected, a notification may be provided to map maintainers, other vehicles, or traffic authorities.

The stored indications of probable traffic controls may also be provided to and utilized by mapping applications. For instance, the mapping applications may determine driving directions for a vehicle that minimize an amount of traffic signals or stop signs encountered along a route, or include a left turn at an intersection that includes a special left turn lane as opposed to a left turn at an interaction which only includes a yield turn lane.

A number of other example scenarios and implementations of the method 100 are described below in connection with FIGS. 2A-4C. For purposes of illustration, multiple example implementations are described. It is to be understood, however, that the example implementations are illustrative only and are not meant to limiting. Other example implementations are possible as well.

FIG. 2 is an example of movement data 200 for a vehicle. Note that the movement data 200 is provided as an example, and actual movement data may be more or less precise. As shown in FIG. 2, the movement data 200 may include position and velocity information that is received from a vehicle (or a mobile device within the vehicle) over a period of time. In the example of FIG. 2, the position and velocity information are received once per second; however, the movement data may be received more or less frequently. The time in the movement data 200 is expressed in UNIX time (i.e., number of seconds since midnight Jan. 1, 1970); though, in other instances, the time may be received in any format such as HH:MM:SS (hour, minute, second) or MM:DD:YYYY:HH:MM:SS (month, date, year, hour, minute, second).

The position information may include a latitude and longitude for each instance of the movement data 200. The latitude and longitude may be in decimal degrees or may be provided in other formats such as degrees, minutes, and seconds, or degrees and compass direction. The velocity information of movement data 200 is provided in the form of a speed and bearing. For instance, the speed is provided in meters/second while the bearing is provided in degrees east of true north. In another example, the velocity may be provided as a vector that includes a velocity component in the north direction and a velocity component in the east direction.

Figure 3:
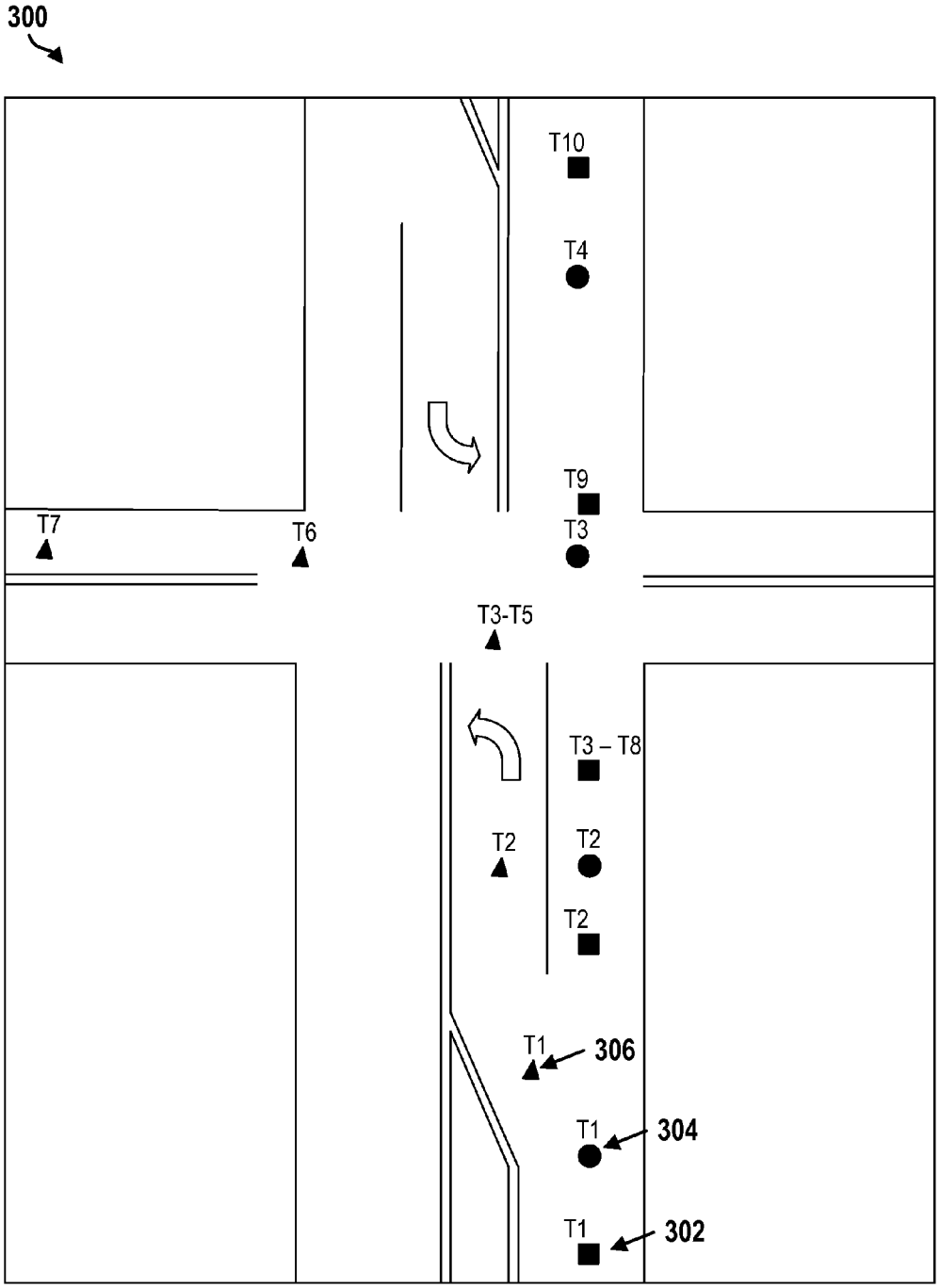
FIG. 3 is an example conceptual illustration of a correlation of movement data to a map.

As described previously, a computing device that receives the movement data 200 may be configured to process the movement data 200 and correlate the movement data to positions on a map. FIG. 3 is an example conceptual illustration of a correlation of movement data to a map 300. In some cases, movement data for a plurality of vehicles traveling through an intersection may be received. For simplicity, only movement data for three vehicles entering the intersection from the bottom direction are shown in FIG. 3. Based on positions and time stamps received for the movement data, each position from the movement data may be associated with a location on the map 300. As shown in FIG. 3, movement data for a first vehicle, represented by the squares 302, may indicate a first path through the intersection. Similarly, movement data for a second vehicle, represented by the circles 304, may indicate movement of another vehicle traveling along the same path through the intersection. Finally, movement data for a third vehicle, represented by the triangles 306, may indicate movement of the third vehicle along a different path through the intersection (i.e., a left turn). In the example of FIG. 3, movement data for each of the three vehicles is received at one second intervals. Each marker (e.g., the squares 302, circles 304, and triangles 306) is numbered in chronological order. Therefore, it can be seen, and determined by a computing device, that the first vehicle pauses for six seconds before going straight through the intersection, while the second vehicle does not appear to stop prior to traveling straight through the intersection.

Figure 4A:
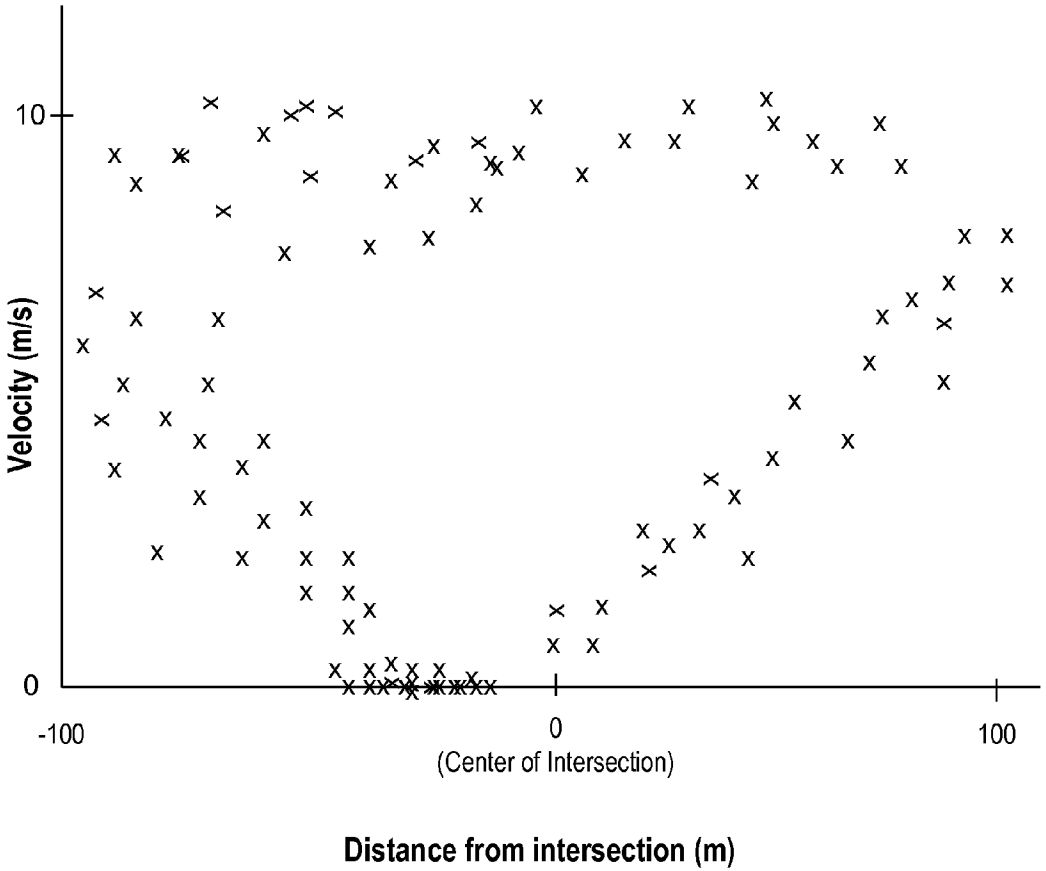
FIGS. 4A-4C are example conceptual illustrations of detected patterns in movement data for a plurality of vehicles.
Figure 4B:
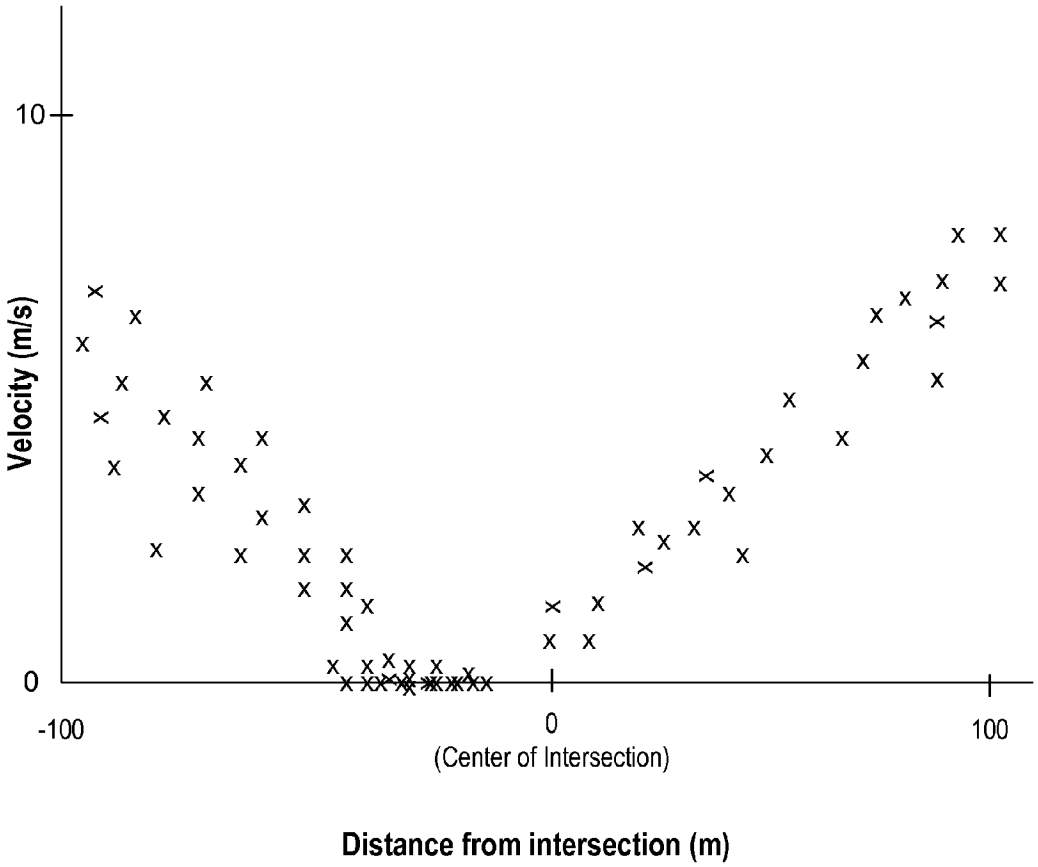
Figure 4C:
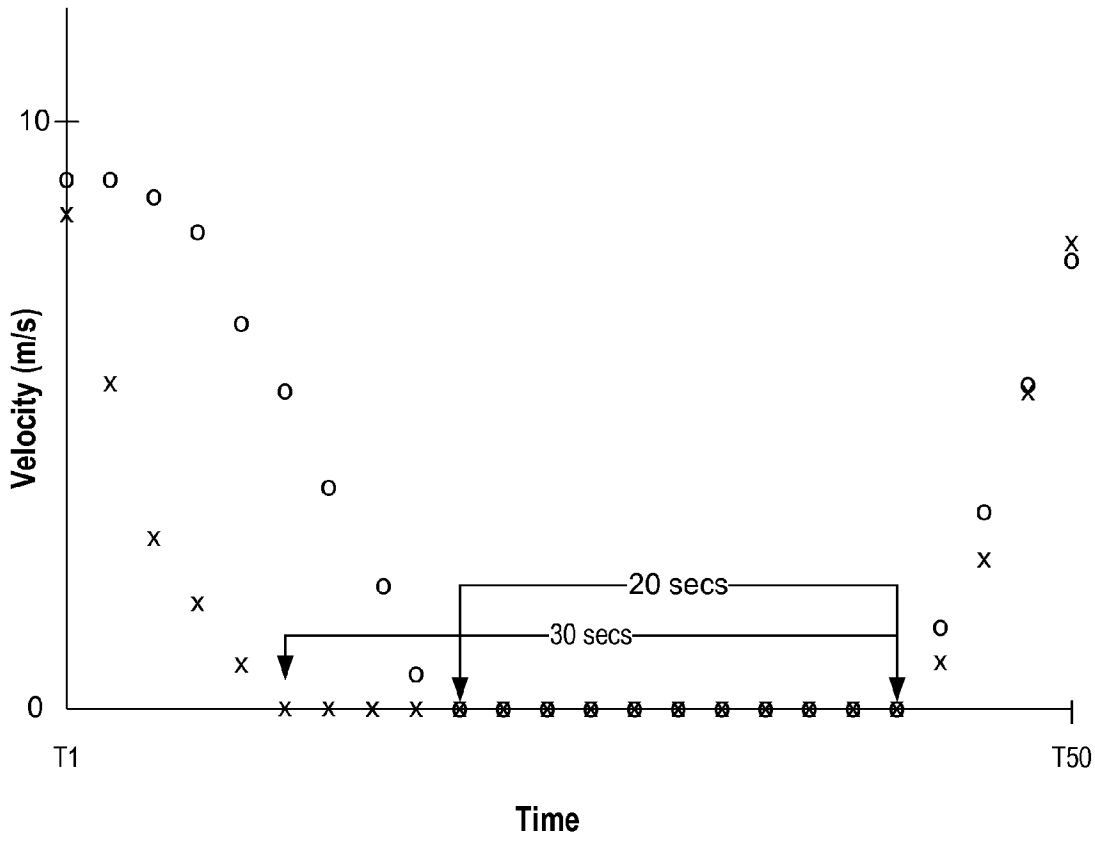

In some instance, by analyzing patterns in the velocity of vehicles traveling through the intersection, further information about probable traffic controls and behaviors of the traffic controls can be inferred from the intersection activity. FIGS. 4A-4C are example conceptual illustrations of detected patterns in movement data for a plurality of vehicles. A computing device may filter movement data near an intersection such that only velocities for vehicles traveling along a given path through the intersection (e.g., straight and north to south) are analyzed. The velocities in FIGS. 4A and 4B are shown with respect to a distance from the intersection. For example, based on the position information of the movement data, velocities at various distances along the path may be determined with respect to a center of the intersection.

In some examples, by analyzing a distribution of velocities that are within a threshold distance of the intersection (e.g., 50 meters before an intersection), the computing device may be able to discern whether a traffic control exists for the path through the intersection. If so, the computing device may also be able to discern a type of traffic control for the probable traffic control.

In the case of FIG. 4A, a bimodal distribution results. The bimodal distribution may be attributed to a traffic signal. For example, in some cases, vehicles may approach and travel through an intersection while it is green. These cases may be represented by velocities near or around 10 m/s. In other cases, the vehicles may approach an intersection while the traffic signal is red, slowing to zero velocity for a period of time. In that case, a number of velocity readings of zero result. Thus, in cases in which a bimodal distribution of velocities exists for positions approaching an intersection, the distribution of velocities may be indicative of a probable traffic signal. One technique for detecting the bimodal distribution is to compare the number of velocities that fall within a first range near zero velocity (e.g., 0 to 0.5 m/s) and the number of velocities that fall within a second range near a speed limit for the path (e.g., 8-12 m/s) for positions that are within 25 meters of the center of the intersection, but not past the center of the intersection. If the numbers of velocities within the first two ranges are similar and the sum of the number of velocities within the first range and the second range are approximately equal to the total number of velocities for the positions that are within 25 meters of the center of the intersection, the numbers may be indicative of a bimodal distribution. Other techniques for detecting bimodal distributions are also possible.

FIG. 4B illustrates a distribution of velocities that may be determined to be indicative of a probable traffic stop sign or flashing red light. For example, the distribution of velocities in FIG. 4B indicates that each of the plurality of vehicles decreases to zero or near zero velocity upon approach to the intersection and before proceeding through the intersection. A technique for screening for a pattern that is indicative of a probable traffic stop sign may involve determining a percentage of vehicles that decrease their velocity below a predetermined threshold (e.g., 0.5 m/s) before proceeding through an intersection, and comparing the percentage to a percentage threshold. For example, if the percentage is greater than 75%, the movement data may be indicative of a probable stop sign.

In some examples, velocities of individual vehicles over time may be analyzed to determine the presence and/or behavior of traffic controls for a given path through an intersection. In FIG. 4C, velocities for a first vehicle are represented by the 'x' markers and velocities for a second vehicle are represented by the 'o' markers. Note that although the velocities overlap along the time axis, the plot is not meant to suggest that the velocities occur at the same instance in time. Rather, the velocities indicate velocities for movement data that is near a location of an intersection. For instance, a computing device may collect and analyze movement data for 40 seconds before a vehicle reaches an intersection and 10 seconds after the vehicle proceeds through the intersection.

As described previously, prolonged periods of stoppage near an intersection (e.g., periods of greater than 1 or 2 second with little or no change in velocity) may be indicative of a probable traffic signal for the intersection. By analyzing a duration of time that a vehicle is stopped before proceeding through the intersection, an estimate of the cycle time of a traffic signal may be determined. As shown in FIG. 4C, a computing device may determine that the first vehicle is stopped for 30 seconds while the second vehicle is stopped for 20 seconds. Therefore, the computing device may estimate that the cycle time is between 20 and 30 seconds. By determining additional cycle times, the computing device may further refine the estimate for the cycle time by averaging the additional cycle times or selecting another percentile value (e.g., $75^{th}$ percentile) of the cycle times as the estimated cycle time.

In other instances, the computing device may correlate velocities of vehicles traveling in one direction and velocities of vehicles traveling in the cross-traffic direction in time to estimate the cycle time for a traffic signal of an intersection. For example, a computing device may receive movement data for a first vehicle traveling north through an intersection and a second vehicle traveling east through an intersection along the intersecting road near the same instance in time. In an instance in which both vehicles are stopped prior to the intersection near the same time, the computing device may calculate an elapsed amount of time between when the first vehicle begins to proceed through the intersection and when the second vehicle later begins to proceed through the intersection. The elapsed amount of time may then be determined to be an estimate for the cycle time of the traffic signal for the intersection.

In another scenario, if an estimate for a cycle time for a traffic signal of an intersection is known and near-real time movement data was recently received for the intersection, the computing device may be capable of estimating the probable state of the traffic signal. For example, if the recently received movement data indicates a vehicle has been stopped at an intersection for a prolonged period of time and has recently begun to proceed through the intersection, the computing device may infer that the traffic signal will be green for the path which the vehicle is taking through the intersection for the next duration of the cycle time (e.g., for the next 20 seconds). Similarly, the computing device may estimate that the traffic signal will turn green for vehicles traveling along the intersecting road for the intersection after one cycle of the cycle time (e.g., in 20 seconds). In some cases, estimates about probable states of traffic signals may be used to provide additional information to drivers/passengers of vehicles or control systems of autonomous vehicles in near-real time. In other cases, estimates about probable states of traffic signals may be utilized by mapping applications when planning routes (e.g., to attempt to arrive at intersections when the probable state is green).

The plurality of vehicles as well as the vehicles configured to operate in an autonomous mode described previously may take a number of forms, including, for example, automobiles, cars, trucks, motorcycles, buses, lawn mowers, earth movers, snowmobiles, recreational vehicles, amusement park vehicles, farm equipment, construction equipment, trams, golf carts, and trolleys. Other vehicles are possible as well.

Figure 5:
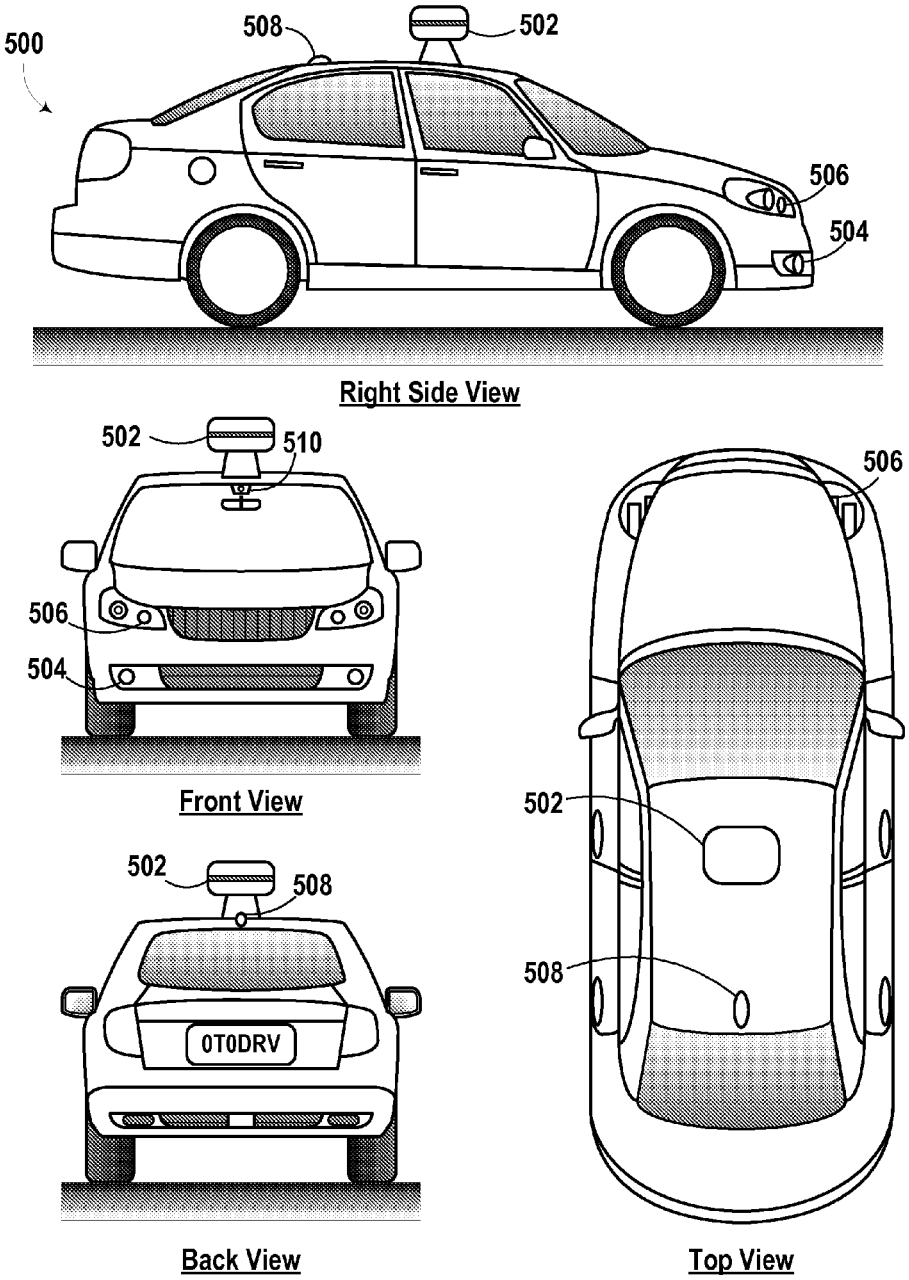
FIG. 5 illustrates an example vehicle, in accordance with an embodiment.

FIG. 5 illustrates an example vehicle 500, in accordance with an embodiment. In particular, FIG. 5 shows a Right Side View, Front View, Back View, and Top View of the vehicle 500. Although vehicle 500 is illustrated in FIG. 5 as a car, other embodiments are possible. For instance, the vehicle 500 could represent a truck, a van, a semi-trailer truck, a motorcycle, a golf cart, an off-road vehicle, or a farm vehicle, among other examples. As shown, the vehicle 500 includes a first sensor unit 502, a second sensor unit 504, a third sensor unit 506, a wireless communication system 508, and a camera 510.

Each of the first, second, and third sensor units 502-506 may include any combination of global positioning system sensors, inertial measurement units, radio detection and ranging (RADAR) units, laser rangefinders, light detection and ranging (LIDAR) units, cameras, and acoustic sensors. Other types of sensors are possible as well.

While the first, second, and third sensor units 502 are shown to be mounted in particular locations on the vehicle 500, in some embodiments the sensor unit 502 may be mounted elsewhere on the vehicle 500, either inside or outside the vehicle 500. Further, while only three sensor units are shown, in some embodiments more or fewer sensor units may be included in the vehicle 500.

In some embodiments, one or more of the first, second, and third sensor units 502-506 may include one or more movable mounts on which the sensors may be movably mounted. The movable mount may include, for example, a rotating platform. Sensors mounted on the rotating platform could be rotated so that the sensors may obtain information from each direction around the vehicle 500. Alternatively or additionally, the movable mount may include a tilting platform. Sensors mounted on the tilting platform could be tilted within a particular range of angles and/or azimuths so that the sensors may obtain information from a variety of angles. The movable mount may take other forms as well.

Further, in some embodiments, one or more of the first, second, and third sensor units 502-506 may include one or more actuators configured to adjust the position and/or orientation of sensors in the sensor unit by moving the sensors and/or movable mounts. Example actuators include motors, pneumatic actuators, hydraulic pistons, relays, solenoids, and piezoelectric actuators. Other actuators are possible as well.

The wireless communication system 508 may be any system configured to wirelessly couple to one or more other vehicles, sensors, or other entities, either directly or via a communication network. To this end, the wireless communication system 508 may include an antenna and a chipset for communicating with the other vehicles, sensors, or other entities either directly or via a communication network. The chipset or wireless communication system 508 in general may be arranged to communicate according to one or more other types of wireless communication (e.g., protocols) such as Bluetooth, communication protocols described in IEEE 802.11 (including any IEEE 802.11 revisions), cellular technology (such as GSM, CDMA, UMTS, EV-DO, WiMAX, or LTE), Zigbee, dedicated short range communications (DSRC), and radio frequency identification (RFID) communications, among other possibilities. The wireless communication system 508 may take other forms as well.

While the wireless communication system 508 is shown positioned on a roof of the vehicle 500, in other embodiments the wireless communication system 508 could be located, fully or in part, elsewhere.

The camera 510 may be any camera (e.g., a still camera, a video camera, etc.) configured to capture images of the environment in which the vehicle 500 is located. To this end, the camera 510 may be configured to detect visible light, or may be configured to detect light from other portions of the spectrum, such as infrared or ultraviolet light. Other types of cameras are possible as well. The camera 510 may be a two-dimensional detector, or may have a three-dimensional spatial range. In some embodiments, the camera 510 may be, for example, a range detector configured to generate a two-dimensional image indicating a distance from the camera 510 to a number of points in the environment. To this end, the camera 510 may use one or more range detecting techniques. For example, the camera 510 may use a structured light technique in which the vehicle 500 illuminates an object in the environment with a predetermined light pattern, such as a grid or checkerboard pattern and uses the camera 510 to detect a reflection of the predetermined light pattern off the object. Based on distortions in the reflected light pattern, the vehicle 500 may determine the distance to the points on the object. The predetermined light pattern may comprise infrared light, or light of another wavelength. As another example, the camera 510 may use a laser scanning technique in which the vehicle 500 emits a laser and scans across a number of points on an object in the environment. While scanning the object, the vehicle 500 uses the camera 510 to detect a reflection of the laser off the object for each point. Based on a length of time it takes the laser to reflect off the object at each point, the vehicle 500 may determine the distance to the points on the object. As yet another example, the camera 510 may use a time-of-flight technique in which the vehicle 500 emits a light pulse and uses the camera 510 to detect a reflection of the light pulse off an object at a number of points on the object. In particular, the camera 510 may include a number of pixels, and each pixel may detect the reflection of the light pulse from a point on the object. Based on a length of time it takes the light pulse to reflect off the object at each point, the vehicle 500 may determine the distance to the points on the object. The light pulse may be a laser pulse. Other range detecting techniques are possible as well, including stereo triangulation, sheet-of-light triangulation, interferometry, and coded aperture techniques, among others. The camera 510 may take other forms as well.

In some embodiments, the camera 510 may include a movable mount and/or an actuator, as described above, that are configured to adjust the position and/or orientation of the camera 510 by moving the camera 510 and/or the movable mount.

While the camera 510 is shown to be mounted inside a front windshield of the vehicle 500, in other embodiments the camera 510 may be mounted elsewhere on the vehicle 500, either inside or outside the vehicle 500.

The vehicle 500 may include one or more other components in addition to or instead of those shown.

Figure 6:
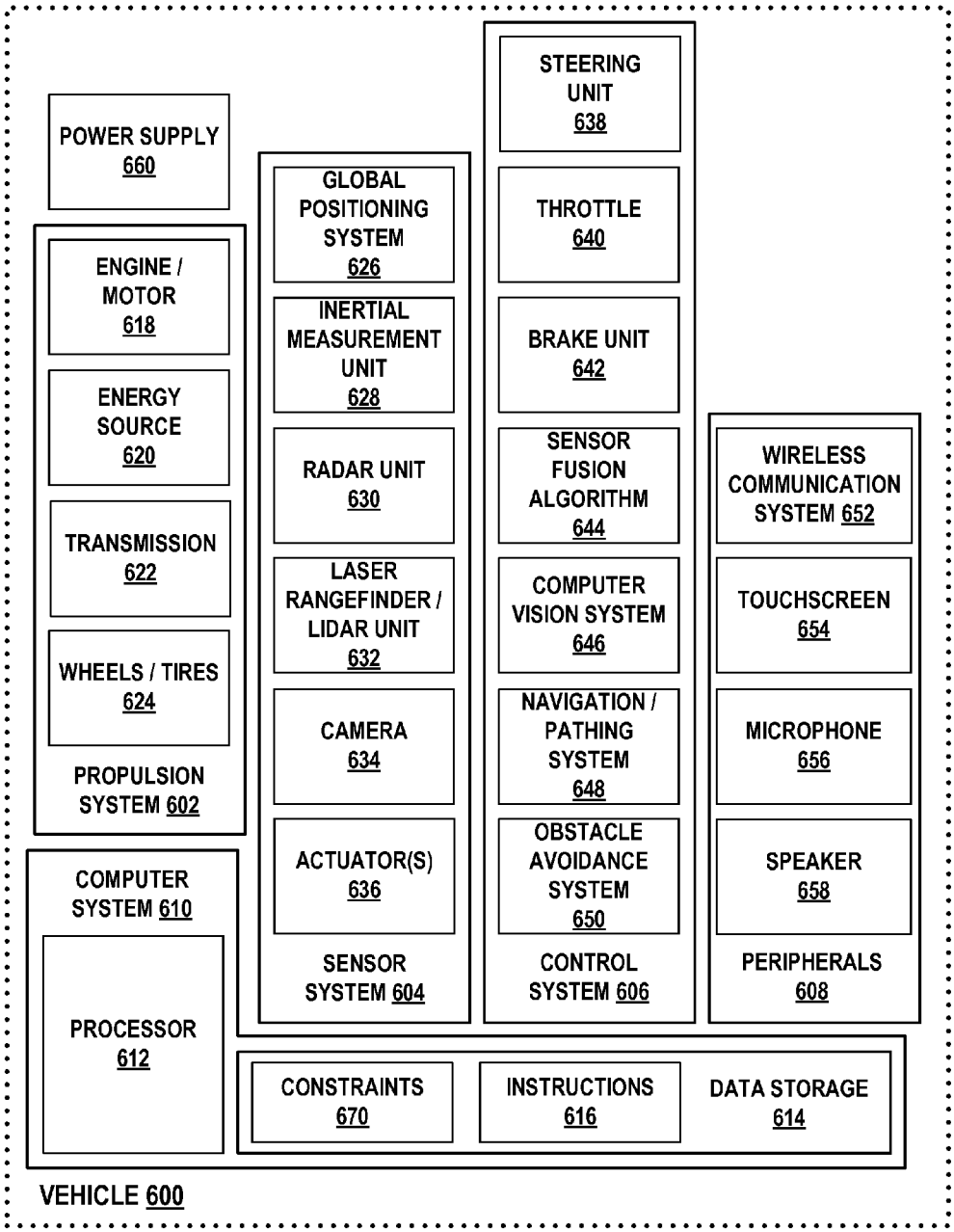
FIG. 6 is a simplified block diagram of an example vehicle, in accordance with an embodiment.

FIG. 6 is a simplified block diagram of an example vehicle 600, in accordance with an embodiment. The vehicle 600 may, for example, be similar to the vehicle 500 described above in connection with FIG. 5. The vehicle 600 may take other forms as well.

As shown, the vehicle 600 includes a propulsion system 602, a sensor system 604, a control system 606, peripherals 608, and a computer system 610 including a processor 612, data storage 614, and instructions 616. In other embodiments, the vehicle 600 may include more, fewer, or different systems, and each system may include more, fewer, or different components. Additionally, the systems and components shown may be combined or divided in any number of ways.

The propulsion system 602 may be configured to provide powered motion for the vehicle 600. As shown, the propulsion system 602 includes an engine/motor 618, an energy source 620, a transmission 622, and wheels/tires 624.

The engine/motor 618 may be or include any combination of an internal combustion engine, an electric motor, a steam engine, and a Stirling engine. Other motors and engines are possible as well. In some embodiments, the propulsion system 602 could include multiple types of engines and/or motors. For instance, a gas-electric hybrid car could include a gasoline engine and an electric motor. Other examples are possible.

The energy source 620 may be a source of energy that powers the engine/motor 618 in full or in part. That is, the engine/motor 618 may be configured to convert the energy source 620 into mechanical energy. Examples of energy sources 620 include gasoline, diesel, propane, other compressed gas-based fuels, ethanol, solar panels, batteries, and other sources of electrical power. The energy source(s) 620 could additionally or alternatively include any combination of fuel tanks, batteries, capacitors, and/or flywheels. In some embodiments, the energy source 620 may provide energy for other systems of the vehicle 600 as well.

The transmission 622 may be configured to transmit mechanical power from the engine/motor 618 to the wheels/tires 624. To this end, the transmission 622 may include a gearbox, clutch, differential, drive shafts, and/or other elements. In embodiments where the transmission 622 includes drive shafts, the drive shafts could include one or more axles that are configured to be coupled to the wheels/tires 624.

The wheels/tires 624 of vehicle 600 could be configured in various formats, including a unicycle, bicycle/motorcycle, tricycle, or car/truck four-wheel format. Other wheel/tire formats are possible as well, such as those including six or more wheels. In any case, the wheels/tires 624 of vehicle 624 may be configured to rotate differentially with respect to other wheels/tires 624. In some embodiments, the wheels/tires 624 may include at least one wheel that is fixedly attached to the transmission 622 and at least one tire coupled to a rim of the wheel that could make contact with the driving surface. The wheels/tires 624 may include any combination of metal and rubber, or combination of other materials.

The propulsion system 602 may additionally or alternatively include components other than those shown.

The sensor system 604 may include a number of sensors configured to sense information about an environment in which the vehicle 600 is located, as well as one or more actuators 636 configured to modify a position and/or orientation of the sensors. As shown, the sensors of the sensor system include a Global Positioning System (GPS) 626, an inertial measurement unit (IMU) 628, a RADAR unit 630, a laser rangefinder and/or LIDAR unit 632, and a camera 634. The sensor system 604 may include additional sensors as well, including, for example, sensors that monitor internal systems of the vehicle 600 (e.g., an $O_2$ monitor, a fuel gauge, an engine oil temperature, etc.). Other sensors are possible as well.

The GPS 626 may be any sensor configured to estimate a geographic location of the vehicle 600. To this end, the GPS 626 may include a transceiver configured to estimate a position of the vehicle 600 with respect to the Earth. The GPS 626 may take other forms as well.

The IMU 628 may be any combination of sensors configured to sense position and orientation changes of the vehicle 600 based on inertial acceleration. In some embodiments, the combination of sensors may include, for example, accelerometers and gyroscopes. Other combinations of sensors are possible as well.

The RADAR 630 unit may be any sensor configured to sense objects in the environment in which the vehicle 600 is located using radio signals. In some embodiments, in addition to sensing the objects, the RADAR unit 630 may additionally be configured to sense the speed and/or heading of the objects.

Similarly, the laser rangefinder or LIDAR unit 632 may be any sensor configured to sense objects in the environment in which the vehicle 600 is located using lasers. In particular, the laser rangefinder or LIDAR unit 632 may include a laser source and/or laser scanner configured to emit a laser and a detector configured to detect reflections of the laser. The laser rangefinder or LIDAR 632 may be configured to operate in a coherent (e.g., using heterodyne detection) or an incoherent detection mode.

The camera 634 may be any camera (e.g., a still camera, a video camera, etc.) configured to capture images of the environment in which the vehicle 600 is located. To this end, the camera may take any of the forms described above.

The sensor system 604 may additionally or alternatively include components other than those shown.

The control system 606 may be configured to control operation of the vehicle 600 and its components. To this end, the control system 606 may include a steering unit 638, a throttle 640, a brake unit 642, a sensor fusion algorithm 644, a computer vision system 646, a navigation or pathing system 648, and an obstacle avoidance system 650.

The steering unit 638 may be any combination of mechanisms configured to adjust the heading of vehicle 600.

The throttle 640 may be any combination of mechanisms configured to control the operating speed of the engine/motor 618 and, in turn, the speed of the vehicle 600.

The brake unit 642 may be any combination of mechanisms configured to decelerate the vehicle 600. For example, the brake unit 642 may use friction to slow the wheels/tires 624. As another example, the brake unit 642 may convert the kinetic energy of the wheels/tires 624 to electric current. The brake unit 642 may take other forms as well.

The sensor fusion algorithm 644 may be an algorithm (or a computer program product storing an algorithm) configured to accept data from the sensor system 604 as an input. The data may include, for example, data representing information sensed at the sensors of the sensor system 604. The sensor fusion algorithm 644 may include, for example, a Kalman filter, a Bayesian network, or another algorithm. The sensor fusion algorithm 644 may further be configured to provide various assessments based on the data from the sensor system 604, including, for example, evaluations of individual objects and/or features in the environment in which the vehicle 600 is located, evaluations of particular situations, and/or evaluations of possible impacts based on particular situations. Other assessments are possible as well.

The computer vision system 646 may be any system configured to process and analyze images captured by the camera 634 in order to identify objects and/or features in the environment in which the vehicle 600 is located, including, for example, traffic signals and obstacles. To this end, the computer vision system 646 may use an object recognition algorithm, a Structure from Motion (SFM) algorithm, video tracking, or other computer vision techniques. In some embodiments, the computer vision system 646 may additionally be configured to map the environment, track objects, estimate the speed of objects, etc.

The navigation and pathing system 648 may be any system configured to determine a driving path for the vehicle 600. The navigation and pathing system 648 may additionally be configured to update the driving path dynamically while the vehicle 600 is in operation. In some embodiments, the navigation and pathing system 648 may be configured to incorporate data from the sensor fusion algorithm 644, the GPS 626, and one or more predetermined maps so as to determine the driving path for vehicle 600.

The obstacle avoidance system 650 may be any system configured to identify, evaluate, and avoid or otherwise negotiate obstacles in the environment in which the vehicle 600 is located.

The control system 606 may additionally or alternatively include components other than those shown.

Peripherals 608 may be configured to allow the vehicle 600 to interact with external sensors, other vehicles, and/or a user. To this end, the peripherals 608 may include, for example, a wireless communication system 652, a touchscreen 654, a microphone 656, and/or a speaker 658.

The wireless communication system 652 may take any of the forms described above.

The touchscreen 654 may be used by a user to input commands to the vehicle 600. To this end, the touchscreen 654 may be configured to sense at least one of a position and a movement of a user's finger via capacitive sensing, resistance sensing, or a surface acoustic wave process, among other possibilities. The touchscreen 654 may be capable of sensing finger movement in a direction parallel or planar to the touchscreen surface, in a direction normal to the touchscreen surface, or both, and may also be capable of sensing a level of pressure applied to the touchscreen surface. The touchscreen 654 may be formed of one or more translucent or transparent insulating layers and one or more translucent or transparent conducting layers. The touchscreen 654 may take other forms as well.

The microphone 656 may be configured to receive audio (e.g., a voice command or other audio input) from a user of the vehicle 600. Similarly, the speakers 658 may be configured to output audio to the user of the vehicle 600.

The peripherals 608 may additionally or alternatively include components other than those shown.

The computer system 610 may be configured to transmit data to and receive data from one or more of the propulsion system 602, the sensor system 604, the control system 606, and the peripherals 608. To this end, the computer system 610 may be communicatively linked to one or more of the propulsion system 602, the sensor system 604, the control system 606, and the peripherals 608 by a system bus, network, and/or other connection mechanism (not shown).

The computer system 610 may be further configured to interact with and control one or more components of the propulsion system 602, the sensor system 604, the control system 606, and/or the peripherals 608. For example, the computer system 610 may be configured to control operation of the transmission 622 to improve fuel efficiency. As another example, the computer system 610 may be configured to cause the camera 634 to capture images of the environment. As yet another example, the computer system 610 may be configured to store and execute instructions corresponding to the sensor fusion algorithm 644. As still another example, the computer system 610 may be configured to store and execute instructions for displaying a display on the touchscreen 654. Other examples are possible as well.

As shown, the computer system 610 includes the processor 612 and data storage 614. The processor 612 may comprise one or more general-purpose processors and/or one or more special-purpose processors. To the extent the processor 612 includes more than one processor, such processors could work separately or in combination. Data storage 614, in turn, may comprise one or more volatile and/or one or more non-volatile storage components, such as optical, magnetic, and/or organic storage, and data storage 614 may be integrated in whole or in part with the processor 612.

In some embodiments, data storage 614 may contain instructions 616 (e.g., program logic) executable by the processor 612 to execute various vehicle functions. Further, data storage 614 may contain constraints 670 for the vehicle 600, which may take any of the forms described above. Data storage 614 may contain additional instructions as well, including instructions to transmit data to, receive data from, interact with, and/or control one or more of the propulsion system 602, the sensor system 604, the control system 606, and the peripherals 608.

The computer system 602 may additionally or alternatively include components other than those shown.

As shown, the vehicle 600 further includes a power supply 660, which may be configured to provide power to some or all of the components of the vehicle 600. To this end, the power supply 660 may include, for example, a rechargeable lithium-ion or lead-acid battery. In some embodiments, one or more banks of batteries could be configured to provide electrical power. Other power supply materials and configurations are possible as well. In some embodiments, the power supply 660 and energy source 620 may be implemented together, as in some all-electric cars.

In some embodiments, one or more of the propulsion system 602, the sensor system 604, the control system 606, and the peripherals 608 could be configured to work in an interconnected fashion with other components within and/or outside their respective systems.

Further, the vehicle 600 may include one or more elements in addition to or instead of those shown. For example, the vehicle 600 may include one or more additional interfaces and/or power supplies. Other additional components are possible as well. In such embodiments, data storage 614 may further include instructions executable by the processor 612 to control and/or communicate with the additional components.

Still further, while each of the components and systems are shown to be integrated in the vehicle 600, in some embodiments, one or more components or systems may be removably mounted on or otherwise connected (mechanically or electrically) to the vehicle 600 using wired or wireless connections.

The vehicle 600 may take other forms as well.

In some examples, the vehicle 600 may be configured to store movement data that is obtained via GPS 626 and/or IMU 628 while the vehicle 600 is operating. Additionally, the vehicle 600 may be configured to transmit the movement data via wireless communication system 652 to a server in a computing system. For instance, the movement data be provided in near-real time or after the fact. A user of the vehicle 600 may be able to opt-in or opt-out of recording and/or transmitting the movement data.

The vehicle 600 may also be configured to receive indications of probable traffic controls. For example, the vehicle 600 may receive a map having locations of known traffic controls or information that may be used to update an existing map with indications of new traffic controls or changes to traffic controls. In one example, the vehicle 600 may receive the indications of the probable traffic controls from a server via the wireless communication system 652. It is contemplated that the indications of probable traffic controls may be received periodically, on-demand, or according to a user-configured schedule.

Figure 7:
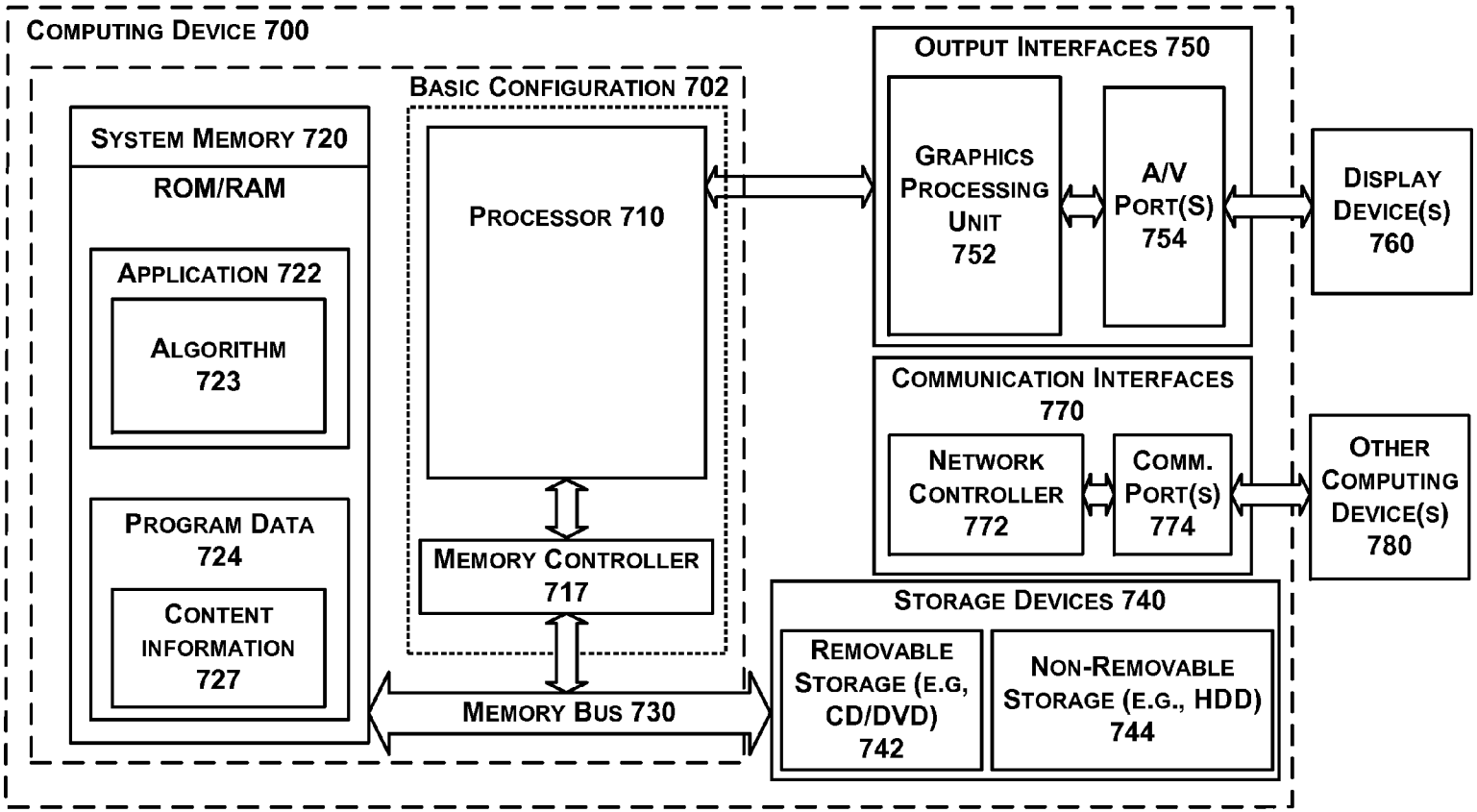
FIG. 7 is a functional block diagram illustrating an example computing device used in a computing system that is arranged in accordance with at least some embodiments described herein.

FIG. 7 is a functional block diagram illustrating an example computing device 700 used in a computing system that is arranged in accordance with at least some embodiments described herein. The computing device 700 may be a personal computer, mobile device, cellular phone, touch-sensitive wristwatch, tablet computer, video game system, or global positioning system, which may be implemented to determine and/or provide movement data to another computing device. Additionally, in other examples, the computing device may be a computing device in a server that is implemented to provide a system for determining the presence and/or behavior of traffic controls as described in FIGS. 1-4C. In a basic configuration 702, computing device 700 may typically include one or more processors 710 and system memory 720. A memory bus 730 can be used for communicating between the processor 710 and the system memory 720. Depending on the desired configuration, processor 710 can be of any type including but not limited to a microprocessor (μP), a microcontroller (μC), a digital signal processor (DSP), or any combination thereof. A memory controller 717 can also be used with the processor 710, or in some implementations, the memory controller 717 can be an internal part of the processor 710.

Depending on the desired configuration, the system memory 720 can be of any type including but not limited to volatile memory (such as RAM), non-volatile memory (such as ROM, flash memory, etc.) or any combination thereof. System memory 720 may include one or more applications 722, and program data 724. Application 722 may include an algorithm 723 that is arranged to provide inputs to the electronic circuits, in accordance with the present disclosure. Program data 724 may include content information 727 that could be directed to any number of types of data. In some example embodiments, application 722 can be arranged to operate with program data 724 on an operating system. For instance, application 722 may be a GPS application configured to send movement data to another computing device via a wireless communication network (e.g., to a server via a satellite). In another instance, the application 722 may be a pattern detection application, configured to detect patterns in movement data.

Computing device 700 can have additional features or functionality, and additional interfaces to facilitate communications between the basic configuration 702 and any devices and interfaces. For example, data storage devices 740 can be provided including removable storage devices 742, non-removable storage devices 744, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Computer storage media can include volatile and nonvolatile, non-transitory, removable and non-removable media implemented in any method or technology for storage of information, such as computer readable instructions, data structures, program modules, or other data.

System memory 720 and storage devices 740 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 700. Any such computer storage media can be part of computing device 700.

Computing device 700 can also include output interfaces 750 that may include a graphics processing unit 752, which can be configured to communicate to various external devices such as display devices 760 or speakers via one or more A/V ports 754 or a communication interface 770. The communication interface 770 may include a network controller 772, which can be arranged to facilitate communications with one or more other computing devices 780 over a network communication via one or more communication ports 774. The communication connection is one example of a communication media. Communication media may be embodied by computer readable instructions, data structures, program modules, or other data in a modulated data signal, such as a carrier wave or other transport mechanism, and includes any information delivery media. A modulated data signal can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR) and other wireless media.

Computing device 700 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 700 can also be implemented as a personal computer including both laptop computer and non-laptop computer configurations.

Figure 8:
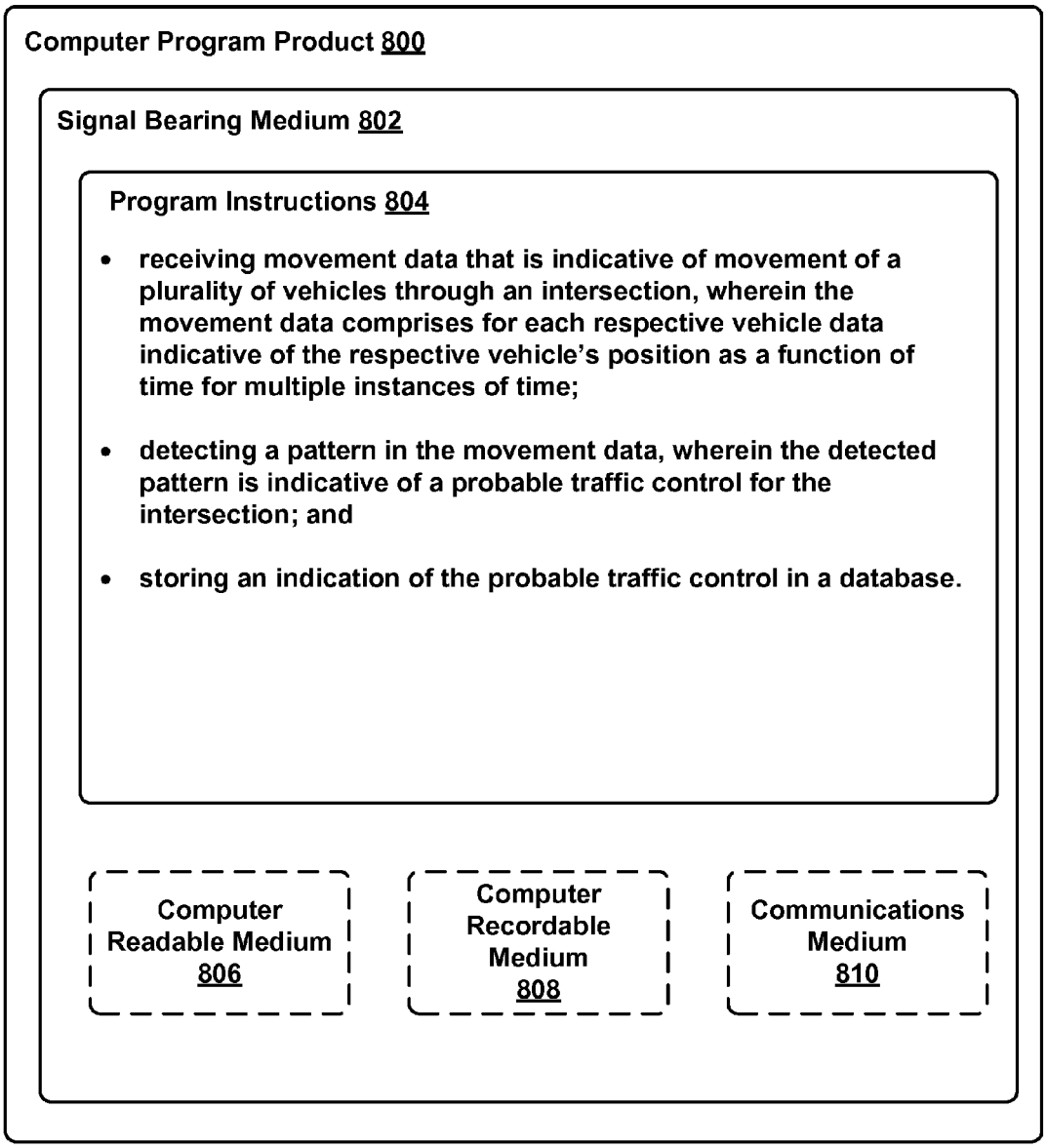
FIG. 8 is a schematic illustrating a conceptual partial view of an example computer program product that includes a computer program for executing a computer process on a computing device, arranged according to at least some embodiments presented herein.

In some embodiments, the disclosed methods may be implemented as computer program instructions encoded on a non-transitory computer-readable storage media in a machine-readable format, or on other non-transitory media or articles of manufacture. FIG. 8 is a schematic illustrating a conceptual partial view of an example computer program product 800 that includes a computer program for executing a computer process on a computing device, arranged according to at least some embodiments presented herein.

In one embodiment, the example computer program product 800 is provided using a signal bearing medium 802. The signal bearing medium 802 may include one or more programming instructions 804 that, when executed by one or more processors, may provide functionality or portions of the functionality described above with respect to FIGS. 1-6.

In some embodiments, the signal bearing medium 802 may encompass a computer-readable medium 806, such as, but not limited to, a hard disk drive, a Compact Disc (CD), a Digital Video Disk (DVD), a digital tape, memory, etc. Further, in some embodiments the signal bearing medium 802 may encompass a computer recordable medium 806, such as, but not limited to, memory, read/write (R/W) CDs, R/W DVDs, etc. Still further, in some embodiments the signal bearing medium 802 may encompass a communications medium 810, such as, but not limited to, a digital and/or an analog communication medium (e.g., a fiber optic cable, a waveguide, a wired communications link, a wireless communication link, etc.). Thus, for example, the signal bearing medium 802 may be conveyed by a wireless form of the communications medium 810.

The one or more programming instructions 804 may be, for example, computer executable and/or logic implemented instructions. In some examples, a computing device such as the computing device 700 of FIG. 7 may be configured to provide various operations, functions, or actions in response to the programming instructions 804 being conveyed to the computing device 700 by one or more of the computer readable medium 806, the computer recordable medium 806, and/or the communications medium 810.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunctions with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method comprising:

receiving, by a computing device, movement data that is indicative of movement of a plurality of vehicles through an intersection, wherein the movement data comprises for each respective vehicle data indicative of the respective vehicle's position as a function of time for multiple instances of time and the respective vehicle's velocity as a function of time for the multiple instances of time;

detecting a pattern in a distribution of velocities of the plurality of vehicles within a threshold distance of the intersection using the computing device;

determining, based at least upon a presence of decreasing velocities and subsequent increasing velocities within the pattern, that the distribution of velocities is indicative of a presence of a probable traffic control for the intersection; and storing an indication of the probable traffic control for the intersection in a database.

2. The method of claim 1, wherein the movement data further comprises for each respective vehicle data indicative of the respective vehicle's acceleration as a function of time for multiple instances of time.

3. The method of claim 1, wherein the movement data is received from mobile devices in each respective vehicle.

4. The method of claim 1, further comprising providing the indication of the probable traffic control for the intersection to a target vehicle, wherein the target vehicle is configured to operate in an autonomous mode.

5. The method of claim 1, further comprising providing the indication of the probable traffic control for the intersection to a mapping application, wherein the mapping application is configured to determine driving directions based on the indication.

6. The method of claim 1, wherein the probable traffic control is a probable traffic signal.

7. The method of claim 6, further comprising determining a cycle time of the probable traffic signal based on the movement data and storing an indication of the cycle time in the database.

8. The method of claim 1, wherein the probable traffic control is a probable traffic sign.

9. A non-transitory computer-readable medium having stored therein instructions executable by a computing device to cause the computing device to perform functions comprising:

receiving movement data that is indicative of movement of a plurality of vehicles through an intersection, wherein the movement data comprises for each respective vehicle data indicative of the respective vehicle's position as a function of time for multiple instances of time and the respective vehicle's velocity as a function of time for the multiple instances of time;

detecting a pattern in a distribution of velocities of the plurality of vehicles within a threshold distance of the intersection;

determining, based at least upon a presence of decreasing velocities and subsequent increasing velocities within the pattern, that the distribution of velocities is indicative of a presence of a probable traffic control for the intersection; and storing an indication of the probable traffic control for the intersection in a database.

10. The non-transitory computer-readable medium of claim 9, wherein the movement data is received from mobile devices in each respective vehicle.

11. The non-transitory computer-readable medium of claim 9, wherein the functions further comprise providing the indication of the probable traffic control for the intersection to a mapping application, wherein the mapping application is configured to determine driving directions based on the indication.

12. The non-transitory computer-readable medium of claim 9, wherein the probable traffic control is a probable traffic signal.

13. The non-transitory computer-readable medium of claim 12, wherein the functions further comprise determining a cycle time of the probable traffic signal based on the movement data and storing an indication of the cycle time in the database.

14. A system comprising:

at least one processor;

a memory; and instructions stored in the memory and executable by the at least one processor to cause the at least one processor to perform functions comprising:

receiving movement data that is indicative of movement of a plurality of vehicles through an intersection, wherein the movement data comprises for each respective vehicle data indicative of the respective vehicle's position as a function of time for multiple instances of time and the respective vehicle's velocity as a function of time for the multiple instances of time;

detecting a pattern in a distribution of velocities of the plurality of vehicles within a threshold distance of the intersection;

determining, based at least upon a presence of decreasing velocities and subsequent increasing velocities within the pattern, that the distribution of velocities is indicative of a presence of a probable traffic control for the intersection; and storing an indication of the probable traffic control for the intersection in a database.

15. The system of claim 14, wherein the movement data is received from mobile devices in each respective vehicle.

16. The system of claim 14, wherein the probable traffic control is a probable traffic signal.

17. The system of claim 14, wherein the functions further comprise providing the indication of the probable traffic control for the intersection to a mapping application, wherein the mapping application is configured to determine driving directions based on the indication.

* * * * *